US011808048B2

(12) United States Patent
Woodward et al.

(10) Patent No.: US 11,808,048 B2
(45) Date of Patent: Nov. 7, 2023

(54) WORK PLATFORM WITH LATCH ASSEMBLY AND METHOD

(71) Applicant: Werner Co., Greenville, PA (US)

(72) Inventors: Steve Woodward, Meadville, PA (US); Joe Dangrow, Mercer, PA (US); Thomas W. Parker, Jamestown, PA (US); Michael A. Somerfield, Hermitage, PA (US)

(73) Assignee: Werner Co., Greenville, PA (US)

( * ) Notice: Subject to any disclaimer, the term of this patent is extended or adjusted under 35 U.S.C. 154(b) by 717 days.

(21) Appl. No.: 16/590,009

(22) Filed: Oct. 1, 2019

(65) Prior Publication Data

US 2020/0032530 A1 Jan. 30, 2020

Related U.S. Application Data

(63) Continuation of application No. 15/077,560, filed on Mar. 22, 2016, now Pat. No. 10,435,894.

(51) Int. Cl.

| | |
|---|---|
| ***E04G 1/04*** | (2006.01) |
| ***E04G 1/32*** | (2006.01) |
| ***E04G 1/34*** | (2006.01) |

(52) U.S. Cl.

CPC ..... *E04G 1/04* (2013.01); *E04G 1/32* (2013.01); *E04G 1/34* (2013.01)

(58) Field of Classification Search

CPC .... E04G 1/04; E04G 1/32; E04G 1/34; E04G 2001/302; E04G 1/30; B25H 5/00

See application file for complete search history.

(56) References Cited

U.S. PATENT DOCUMENTS 4,967,877 A * 11/1990 Wallman ..... B25H 1/06 182/186.3
5,052,517 A * 10/1991 Wallman ..... B25H 1/06 182/186.3

(Continued)

FOREIGN PATENT DOCUMENTS

| | | |
|---|---|---|
| CN | 2908669 | 6/2007 |
| EP | 2000612 | 12/2008 |

(Continued)

OTHER PUBLICATIONS

Werner, "AP-20 Aluminum Work Platform Type II", (Feb. 15, 2016), pp. 1-2, URL: https://web.archive.org/web/2016-02-27053413/http://www.wernerco.com/us/en/view/Products/Climbing Equipment/Portable Scaffold/AP/AP-20.

(Continued)

*Primary Examiner* — Hanh V Tran

(74) *Attorney, Agent, or Firm* — FITCH, EVEN, TABIN & FLANNERY LLP

(57) ABSTRACT

A scaffold upon which a person stands includes a platform with a first leg assembly rotatably attached to the platform. The scaffold includes a latch assembly having a latch pivot axis coupled to the platform. The scaffold includes a stud attached to a first leg of the first leg assembly to which the latch assembly engages when the first leg assembly is moved into the extended position to automatically lock the first leg assembly in the extended position where the latch assembly is in a set position. When the latch assembly is moved out of the set position, the stud on the first leg disengages from the latch assembly and the first leg assembly is able to rotate about the first leg assembly pivot axis to a folded position. A method for using a scaffold.

19 Claims, 9 Drawing Sheets

(56) References Cited

U.S. PATENT DOCUMENTS

| | | | | |
|---|---|---|---|---|
| 7,690,316 | B2 * | 4/2010 | Yoo | E04G 1/34 108/115 |
| 8,381,873 | B2 * | 2/2013 | Cross | E06C 1/39 182/27 |
| 9,404,305 | B1 * | 8/2016 | Messick | E06C 7/16 |
| 9,752,334 | B2 * | 9/2017 | Foley | E04G 1/34 |
| 2004/0238280 | A1 * | 12/2004 | Gibson | E06C 1/393 182/153 |
| 2006/0169539 | A1 * | 8/2006 | Grebinoski | E04G 1/15 182/223 |
| 2009/0133959 | A1 * | 5/2009 | Eriksson | E04G 1/34 182/118 |
| 2010/0071996 | A1 * | 3/2010 | Huang | E04G 1/34 182/118 |
| 2014/0190769 | A1 * | 7/2014 | Parker | E06C 1/393 182/159 |

FOREIGN PATENT DOCUMENTS

| | | | |
|---|---|---|---|
| JP | 3030253 | B2 * | 4/2000 |
| JP | 2002201794 | A * | 7/2002 |
| JP | 2004011126 | | 1/2004 |

OTHER PUBLICATIONS

Werner, "AP-20-MP6Work Platform", (Jan. 2005), pp. 1-2, URL: http://www.wernerco.com/docs/us/userguides/ap-20.pdf?Status=Master&sfvrsn=2.

* cited by examiner

WORK PLATFORM WITH LATCH ASSEMBLY AND METHOD

CROSS-REFERENCE TO RELATED APPLICATIONS

This is a continuation of U.S. patent application Ser. No. 15/077,560 filed Mar. 22, 2016, now U.S. Pat. No. 10,435,894, incorporated by reference herein.

FIELD OF THE INVENTION

The present invention is related to a scaffold that has a latch assembly attached to a platform which automatically engages with a stud on a first rail of a first leg assembly when the first leg assembly moves to an extended position and locks the first leg assembly into the extended position. (As used herein, references to the "present invention" or "invention" relate to exemplary embodiments and not necessarily to every embodiment encompassed by the appended claims.) More specifically the present invention is related to a portable scaffold that has a latch assembly attached to a platform which automatically engages with a stud on a first rail of a first leg assembly when the first leg assembly moves to an extended position and locks the first leg assembly into the extended position and only when a force is applied to the latch assembly is the first leg assembly unlocked and able to move out of the extended position to a folded position.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

Portable scaffolds allow users to easily position the scaffold at desired locations and then climb on them to reach heights that they otherwise could not reach from only standing on the ground. Common reasons the use a portable scaffold is to paint or fix objects or install objects at elevated positions above the ground. The portable scaffold must be lightweight so it is easy to carry over reasonable distances, strong to support the weight of a large person who stands on it and stable so it does not collapse or wobble and cause a person standing on it to lose their balance or falloff.

To be lightweight and strong, the scaffold is typically made out of aluminum. For the scaffold to be portable, besides being of a light weight, the legs or rails that support the platform should be able to fold up with the platform so the platform in the folded position can be easily carried without striking walls are objects as it's being carried as well as being able to be stored in a limited space. For the leg assemblies with the legs to fold up, a lightweight and simple latching mechanism is desirable. By being simple, the latch assembly avoids breaking or adding undue weight, or tension or interfering with the use of the scaffold.

BRIEF SUMMARY OF THE INVENTION

The present invention pertains to a scaffold for a person. The scaffold comprises a platform having a first end and an opposing second end and a longitudinal axis upon which the user stands. The scaffold comprises a first leg assembly rotatably attached in proximity to the first end of the platform. The first leg assembly has a first leg, a second leg in spaced relationship and in parallel with the first leg, and a cross bar attached to the first leg and second leg. When the first leg assembly is in an extended position, the first and second legs of the first leg assembly extend essentially perpendicular to the longitudinal axis of the platform and when the first leg assembly is in the folded position, the first and second legs of the first leg assembly extend essentially parallel with the longitudinal axis. The first leg assembly rotates between the extended position and the folded position about a first leg assembly pivot axis; the scaffold comprises a second leg assembly rotatably attached in proximity to the second end of the platform. The scaffold comprises a latch assembly having a latch pivot axis coupled to the platform. The scaffold comprises a stud attached to the first leg to which the latch assembly engages when the first leg assembly is moved into the extended position to automatically lock the first leg assembly in the extended position where the latch assembly is in a set position. When the latch assembly is moved out of the set position, the stud on the first leg disengages from the latch assembly and the first leg assembly is able to rotate about the first leg assembly pivot axis to the folded position.

The present invention pertains to a method for using a scaffold. The method comprises the steps of having a latch assembly coupled to a platform automatically engage with a stud on a first rail of a first leg assembly to lock the first leg assembly in an extended position as the first leg assembly moves from a folded position to the extended position without a person touching the latch assembly, there is the step of placing the platform at a desired location supported by the first rail assembly and a second rail assembly while the first leg assembly is in the extended position, there is the step of having a person stand on the platform while the first leg assembly is in the extended position. There is the step of applying a force to the latch assembly to cause the latch assembly to disengage from the stud. There is the step of moving the first leg assembly from the extended position to the folded position while the force is applied to the latch assembly and the latch assembly is disengaged from the stud.

The present invention pertains to a scaffold on which a person stands. The scaffold comprises a platform having a first end and a second end and a longitudinal axis upon which the user stands. The scaffold comprises a frame attached in proximity to the first end of the platform. The scaffold comprises a first leg assembly having a first leg rotatably attached to the frame, a second leg in spaced relationship and in parallel with the first leg, and a cross bar attached to the first leg and second leg. When the first leg assembly is in an extended position, the first and second legs of the first leg assembly extend essentially perpendicular to the longitudinal axis of the platform and when the first leg assembly is in the folded position, the first and second legs of the first leg assembly extend essentially parallel with the longitudinal axis. The first leg assembly rotates between the extended position and the folded position about a first leg assembly pivot axis. The scaffold comprises a second leg assembly rotatably attached in proximity to the second end of the platform. The scaffold comprises a latch assembly having a latch pivot axis coupled to the platform. The latch axis and the first leg assembly pivot axis are in spaced relationship and permanently fixed in place relative to each other. When the first leg assembly is moved into the extended position, the latch assembly automatically locks the first leg assembly in the extended position where the latch assembly is in a set position. When the latch assembly is moved out of the set position, the first leg assembly is able to rotate about the first leg assembly pivot axis to the folded position.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
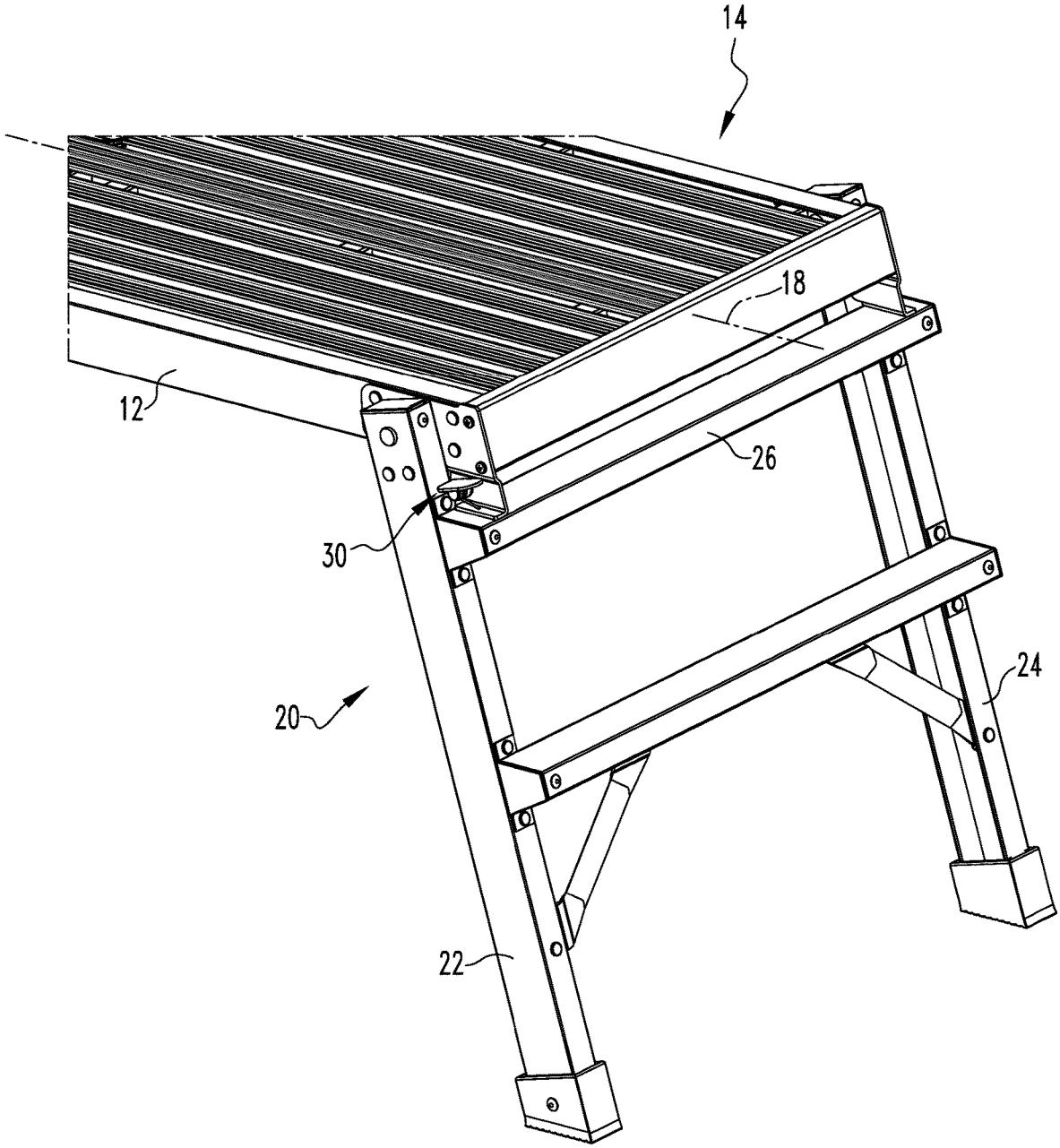
FIG. 1 is a perspective view of a portion of the scaffold having the first leg assembly, the latch assembly in the first end of the platform.
Figure 2:
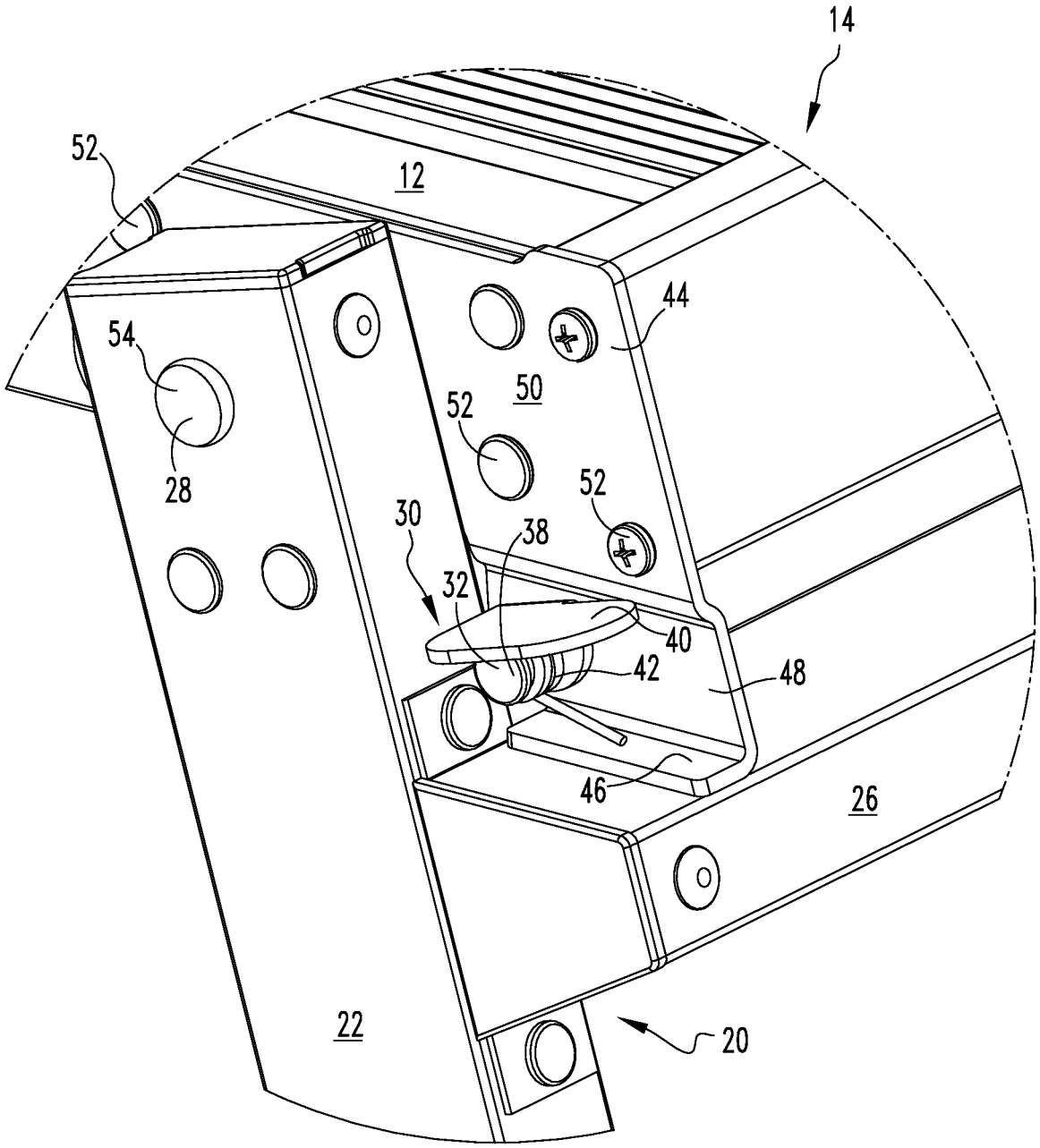
FIG. 2 shows the latch assembly, the frame, and an edge of the first end of the platform.
Figure 3B:
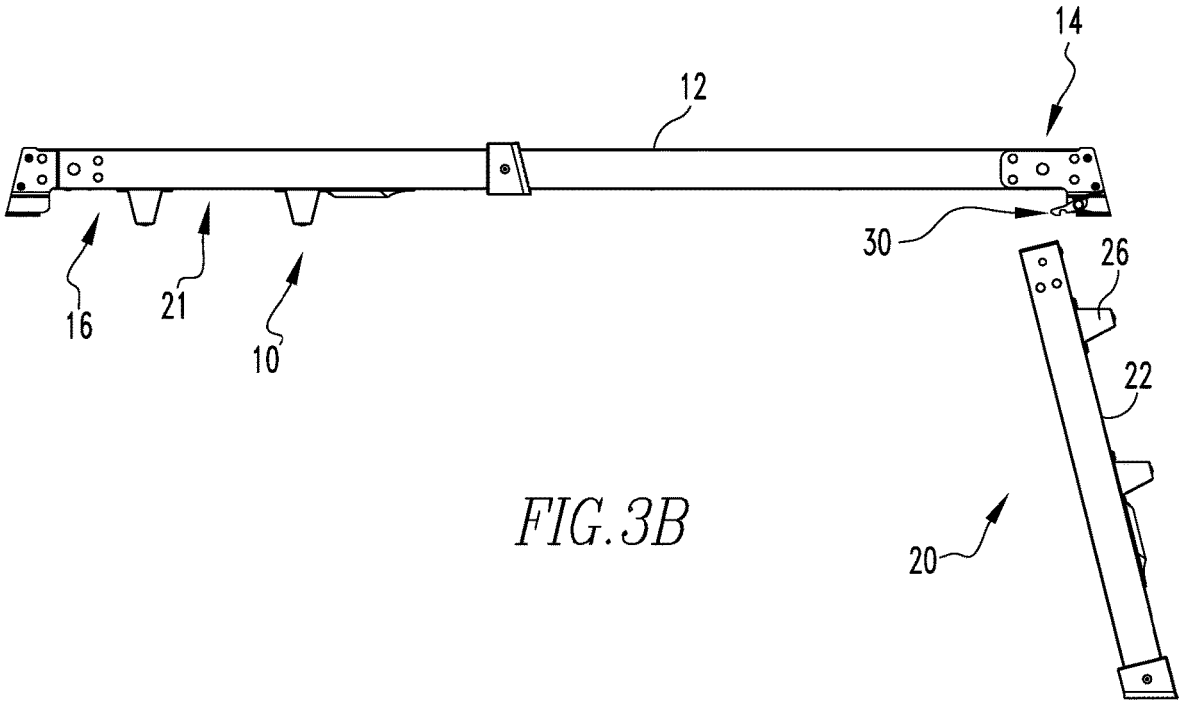
FIG. 3B is an exploded side view of the platform and first leg assembly.
Figure 4A:
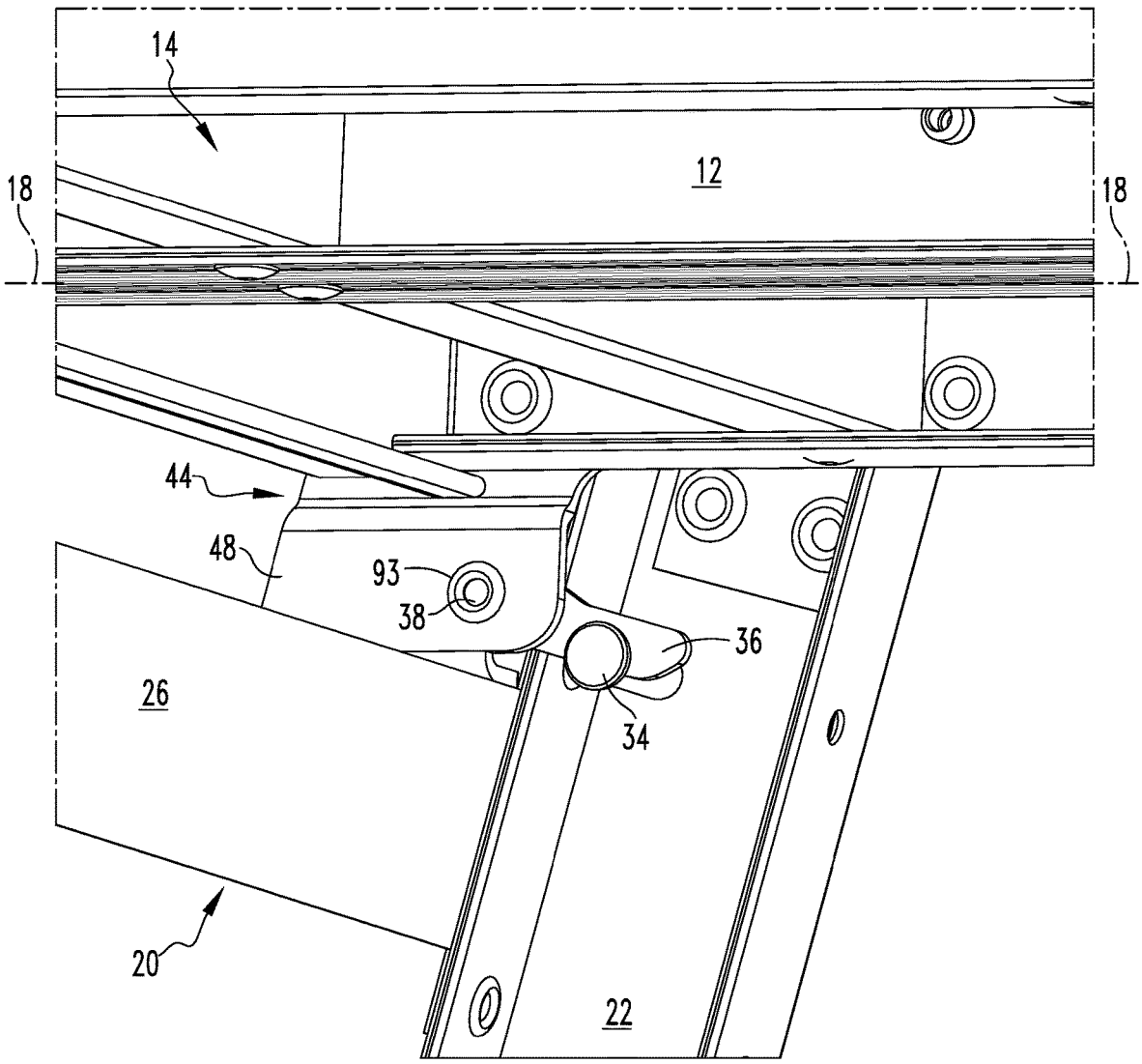
FIG. 4A shows the latch hook engaged with the stud.
Figure 4B:
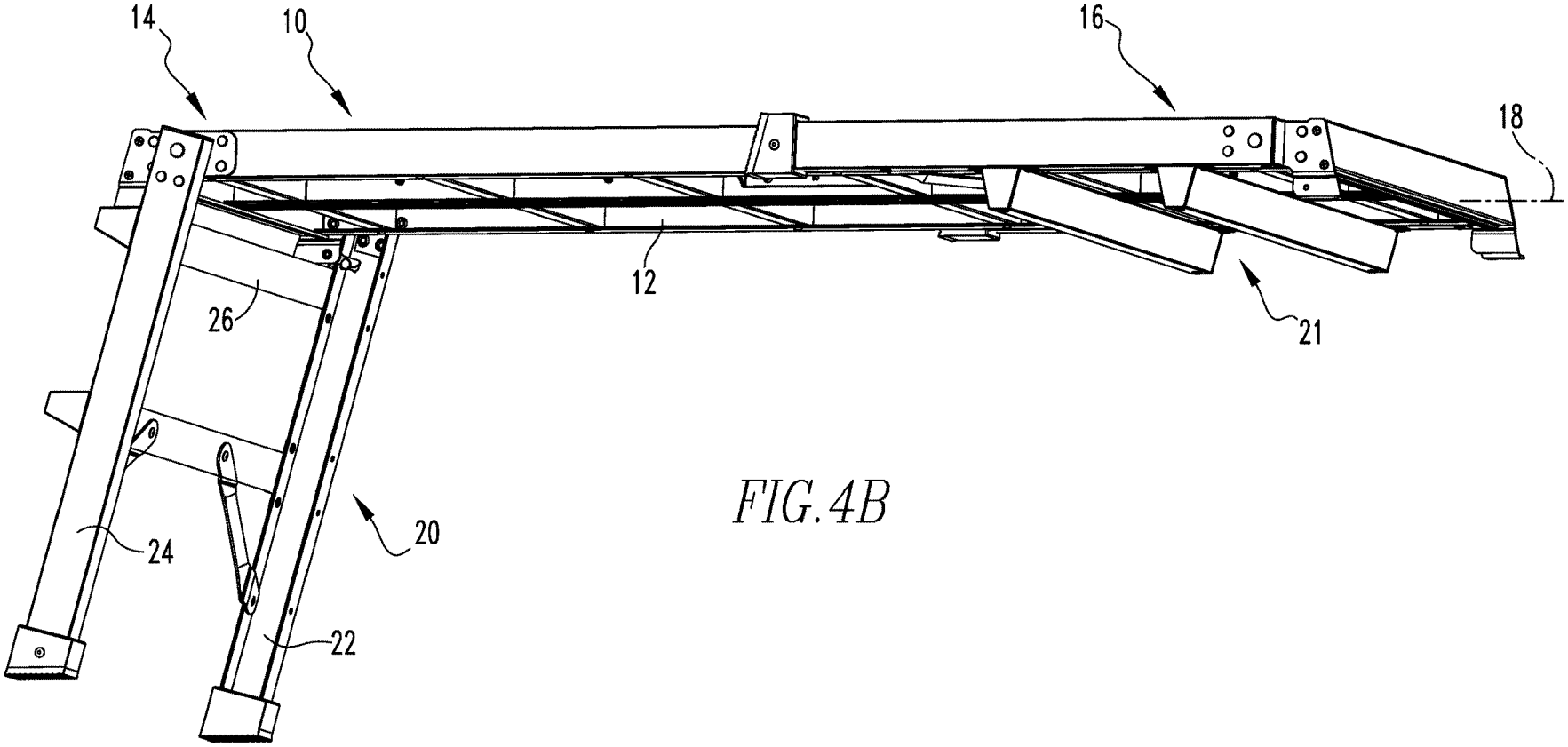
FIG. 4B is a perspective view of the underneath of the scaffold with the first leg assembly in the extended position and the second leg assembly in the folded position.
Figure 5A:
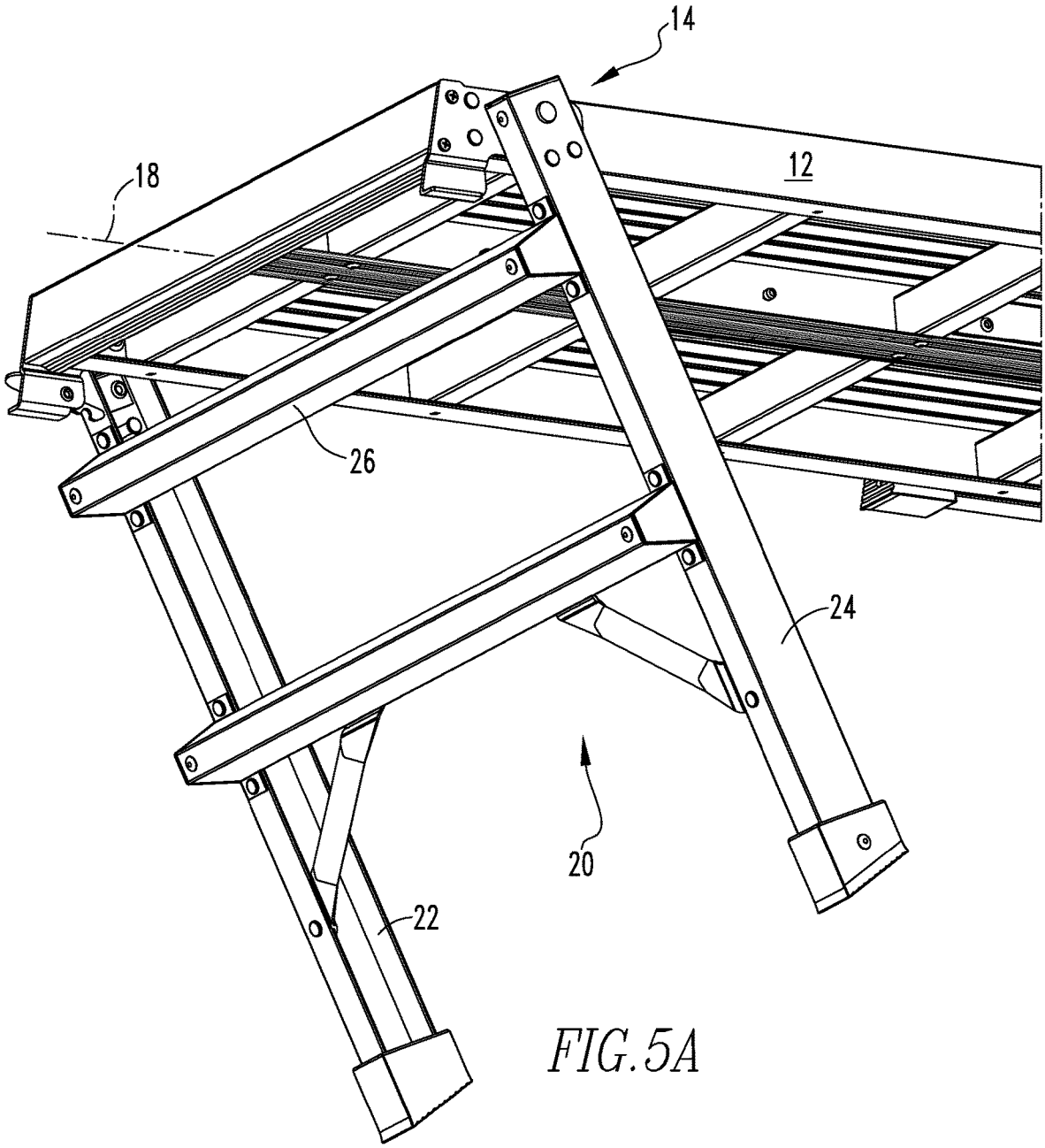
FIG. 5A shows an underneath view of the first leg assembly in a partially folded position relative to the platform.

Referring now to the drawings wherein like reference numerals refer to similar or identical parts throughout the several views, and more specifically to FIGS. 1 and 4B thereof, there is shown a scaffold 10 on which a person stands. The scaffold 10 comprises a platform 12 having a first end 14 and an opposing second end 16 and a longitudinal axis 18 upon which the user stands. The scaffold 10 comprises a first leg assembly 20 rotatably attached in proximity to the first end 14 of the platform 12. The first leg assembly 20 has a first leg 22, a second leg 24 in spaced relationship and in parallel with the first leg 22, and a cross bar 26 attached to the first leg 22 and second leg 24. When the first leg assembly 20 is in an extended position, the first and second legs 22, 24 of the first leg assembly 20 extend essentially perpendicular to the longitudinal axis 18 of the platform 12 and when the first leg assembly 20 is in the folded position, the first and second legs 22, 24 of the first leg assembly 20 extend essentially parallel with the longitudinal axis 18. FIG. 1 shows the first leg assembly 20 in the extended position. FIG. 4B shows the first leg assembly 20 in the folded position and the second leg assembly 21 in the extended position. The first leg assembly 20 rotates between the extended position and the folded position about a first leg assembly pivot axis 28. The scaffold 10 comprises a second leg assembly 21 rotatably attached in proximity to the second end 16 of the platform 12. The scaffold 10 comprises a latch assembly 30 having a latch pivot axis 32 coupled to the platform 12, as shown in FIG. 2. The scaffold 10 comprises a stud 34 directly attached to the first leg 22, as shown in FIG. 4A, to which the latch assembly 30 engages when the first leg assembly 20 is moved into the extended position to automatically lock the first leg assembly 20 in the extended position where the latch assembly 30 is in a set position. When the latch assembly 30 is moved out of the set position, as shown in FIG. 5A, the stud 34 on the first leg 22 disengages from the latch assembly 30 and the first leg assembly 20 is able to rotate about the first leg assembly pivot axis 28 to the folded position. FIG. 3B shows a side view of the scaffold 10 with the first leg assembly 20 separated to show the latch assembly 30, with the second leg assembly 21 in the folded position.

Figure 3A:
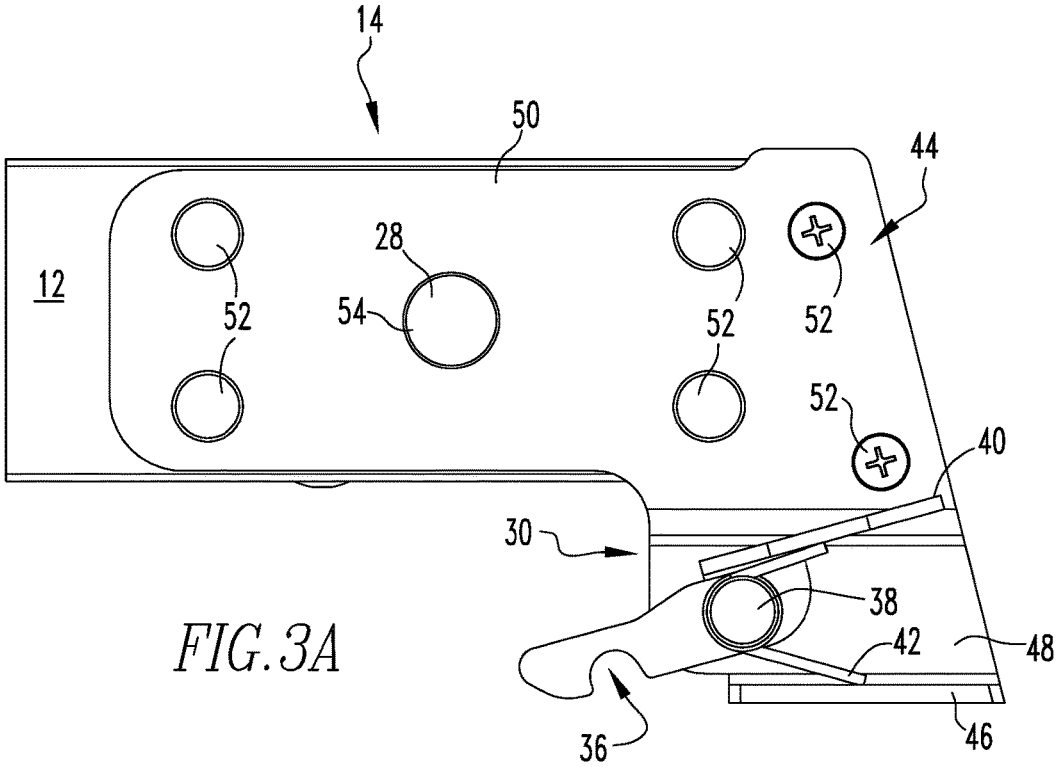
FIG. 3A shows the frame and latch assembly.
Figure 7:
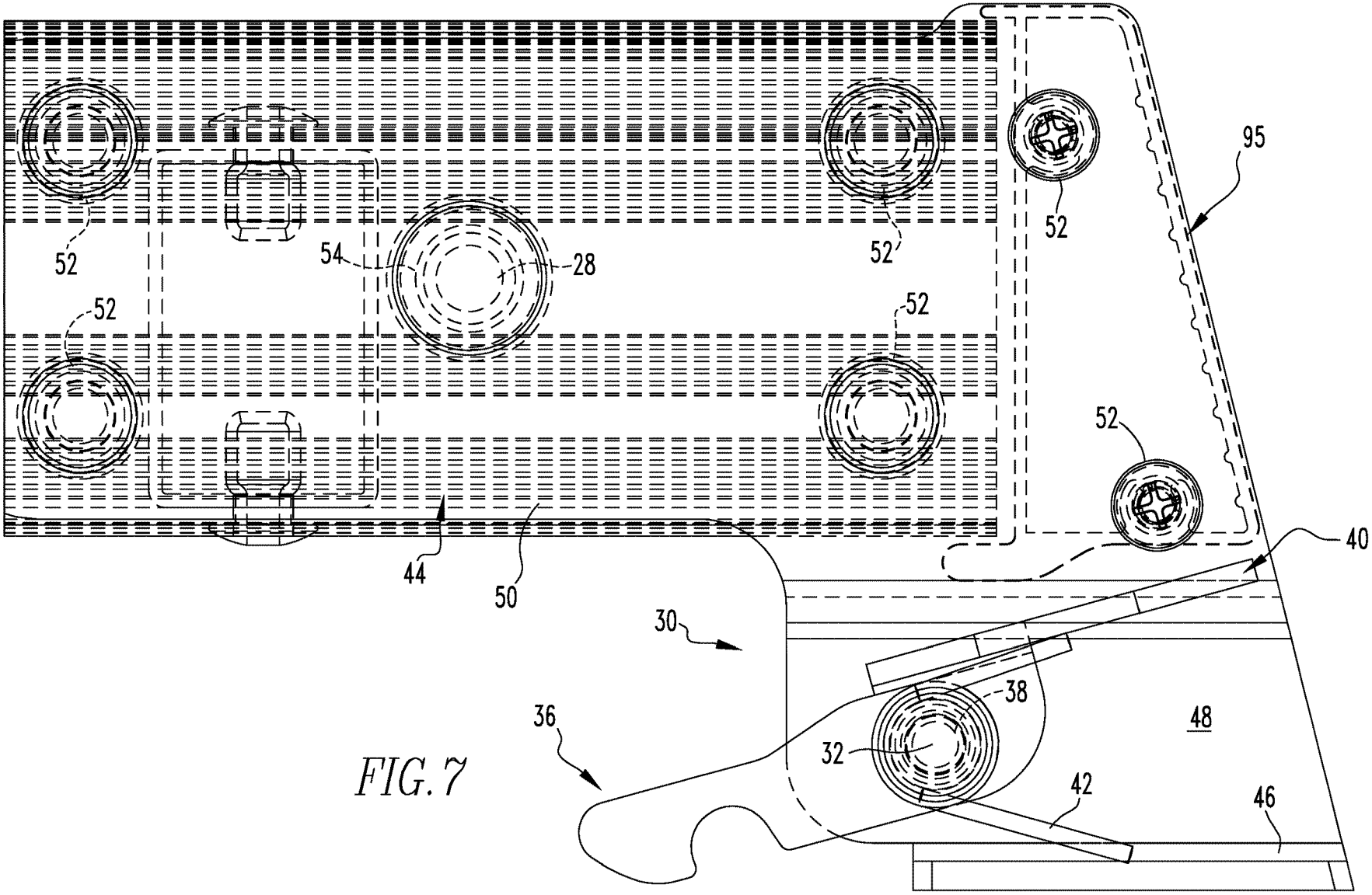
FIG. 7 shows the latch assembly.

The latch axis and the first leg assembly pivot axis 28 may be in spaced relationship and permanently fixed in place relative to each other, as shown in FIGS. 1 and 2. The latch assembly 30 may include a latch hook 36 which directly engages and hooks with the stud 34 in the extended position, as shown in FIGS. 3A, 4A and 7. The latch assembly 30 may include a latch pivot 38 about which the latch hook 36 rotates from the set position. The latch assembly 30 may include a latch actuator 40 engaged with the latch pivot 38 and the latch hook 36 which moves the latch assembly 30 out of the set position when a force is applied to the latch actuator 40. The latch hook 36 may extend inwards towards the platform's middle. The latch assembly 30 may include a latch spring 42 positioned about the latch pivot 38 which applies a restoring force to the latch hook 36 and the latch actuator 40 to automatically move the latch assembly 30 to the set position after the latch assembly 30 has moved from the set position, as shown in 5A, 5B and 7.

Figure 5B:
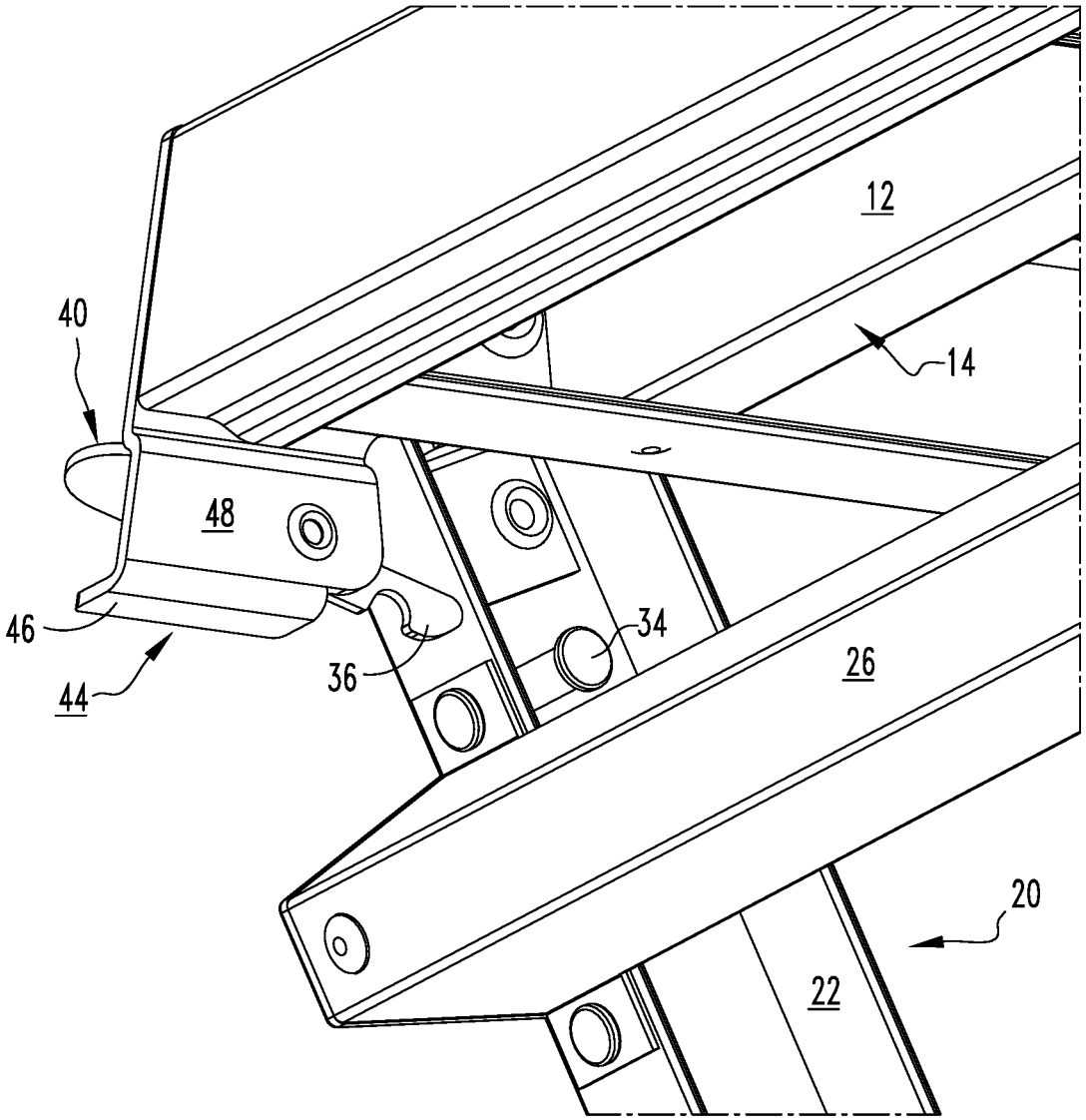
FIG. 5B shows the latch hook position to engage the stud on the first leg assembly.

The latch hook 36 has an outer surface at its tip which may be curved so that when the first leg assembly 20 is moved to the extended position from the folded position, the stud 34 cams the hook and moves the hook so the stud 34 is able to move past the hook, and then for the stud 34 to be locked in place by the hook after the stud 34 clears the hook under the restoring force of the latch spring 42, as shown in FIGS. 4A and 5B. The stud 34 seats in an indentation in the hook when the latch assembly 30 is in the set position and the first leg assembly 20 is in the extended position. The restoring force of the latch spring 42 maintains the indentation of the hook on the stud 34 to capture the stud 34 and prevent the hook from moving off of the stud 34 and releasing the study. The indentation has a curved shape which conforms to the curved outer perimeter of the stud 34 to ensure a secure fitting to minimize and essentially eliminate any chance the latch hook 36 will separate from the stud 34 in the set position when the leg assembly is in the extended position.

The scaffold 10 may include a frame 44 made of plastic or metal, as shown in FIGS. 2 and 3A, to which the first leg 22 is rotatably attached about the first leg assembly pivot axis 28 and to which the platform 12 is attached. The frame 44 is disposed between the first leg 22 and the platform 12. The frame 44 may have a frame edge 46 that contacts the crossbar when the first leg assembly 20 is in the extended position and which acts as a stop to the first leg assembly 20 at the extended position. The frame 44 may have a free wall 48 attached to the frame edge 46 to which the latch pivot 38 extends outwards relative to the longitudinal axis 18 of the platform 12. The free wall 48 and the frame edge 46 are disposed below and in spaced relationship with the platform 12 and an end cap at the first end 14 of the platform 12. The frame edge 46 forms essentially a right angle with the free wall 48. The free wall 48 is connected to and below a frame primary portion 50 through which fasteners 52 fix the frame 44 to the platform 12, and a leg pivot extends to rotatably attached the first leg 22 to the platform 12. The stud 34 may have a circular cross section and extends only partly from the inside of the first rail toward the second rail but not contacting the second rail, as shown in FIGS. 4A and 5B.

The present invention pertains to a method for using a scaffold 10. The method comprises the steps of having a latch assembly 30 coupled to a platform 12 automatically engage with a stud 34 on a first rail of a first leg assembly 20 to lock the first leg assembly 20 in an extended position as the first leg assembly 20 moves from a folded position to the extended position without a person touching the latch assembly 30, there is the step of placing the platform 12 at a desired location supported by the first rail assembly and a second rail assembly while the first leg assembly 20 is in the extended position, there is the step of having a person stand on the platform 12 while the first leg assembly 20 is in the extended position. There is the step of applying a force to the latch assembly 30 to cause the latch assembly 30 to disengage from the stud 34. There is the step of moving the first leg assembly 20 from the extended position to the folded position while the force is applied to the latch assembly 30 and the latch assembly 30 is disengaged from the stud 34.

The present invention pertains to a scaffold 10 on which a person stands, as shown in FIGS. 1, 2 and 4A. The scaffold 10 comprises a platform 12 having a first end 14 and a second end 16 and a longitudinal axis 18 upon which the user stands. The scaffold 10 comprises a frame 44 attached in proximity to the first end 14 of the platform 12. The scaffold 10 comprises a first leg assembly 20 having a first leg 22 rotatably attached to the frame 44, a second leg 24 in spaced relationship and in parallel with the first leg 22, and a cross bar 26 attached to the first leg 22 and second leg 24. When the first leg assembly 20 is in an extended position, the first and second legs 22, 24 of the first leg assembly 20 extend essentially perpendicular to the longitudinal axis 18 of the platform 12 and when the first leg assembly 20 is in the folded position, the first and second legs 22, 24 of the first leg assembly 20 extend essentially parallel with the longitudinal axis 18. The first leg assembly 20 rotates between the extended position and the folded position about a first leg assembly pivot axis 28. The scaffold 10 comprises a second leg assembly 21 rotatably attached in proximity to the second end 16 of the platform 12. The scaffold 10 comprises a latch assembly 30 having a latch pivot axis 32 coupled to the platform 12. The latch axis and the first leg assembly pivot axis 28 are in spaced relationship and permanently fixed in place relative to each other. When the first leg assembly 20 is moved into the extended position, the latch assembly 30 automatically locks the first leg assembly 20 in the extended position where the latch assembly 30 is in a set position. When the latch assembly 30 is moved out of the set position, the first leg assembly 20 is able to rotate about the first leg assembly pivot axis 28 to the folded position.

As shown in FIG. 2, the latch pivot 38 is a circular rod made of plastic or metal that extends outwards from the free wall 48 of the frame 44 on the outside of the free wall 48, no more than 2 or 3 inches, and is fixed in place to the inside of the free wall 48, as shown in FIG. 4A with a fastener closer 93, such as a rivet closure, as is well known in the art. The rod of the has a base which contacts the free wall 48, an intermediate portion that extends from the base that has a smaller outside diameter than the outside diameter of the base and a tip at the end of the intermediate portion, with the intermediate portion between the tip and the base. The tip has a larger outside diameter than the outside diameter of the intermediate portion. By the intermediate portion having a smaller outside diameter than the tip and the base, a groove is formed in which the latch spring 42 is securely seated between the tip and the base.

The latch actuator 40 may be a flat plate attached to the top of the tip and the base of the rod of the latch pivot 38. A person presses on the plate to rotate the rod and compress the latch spring 42 to cause the latch hook 36 to lift off of the stud 34 and out of the set position so the first leg assembly 20 can disengage from the latch assembly 30 and be moved to the folded position. The person is no longer applying a force impressing on the plate, the latch spring 42 under its restoring force automatically moves the latch assembly 30 back to the set position. Similarly, even though there is no force applied to the plate, when the first leg assembly 20 is moved to the extended position, as explained above, the stud 34 cams the latch hook 36 up causing the rod to rotate and compress the latch spring 42, allowing the stud 34 to move into the indentation in the hook and seat into the indentation in the hook, where the restoring force of the latch spring 42 causes the indentation of the hook to move down and capture the stud 34. By the plate being attached to the top of the tip and the base of the rod, it also captures the latch spring 42 in the groove further prevents the latch spring 42 from coming loose and separating from the rod.

Figure 6:
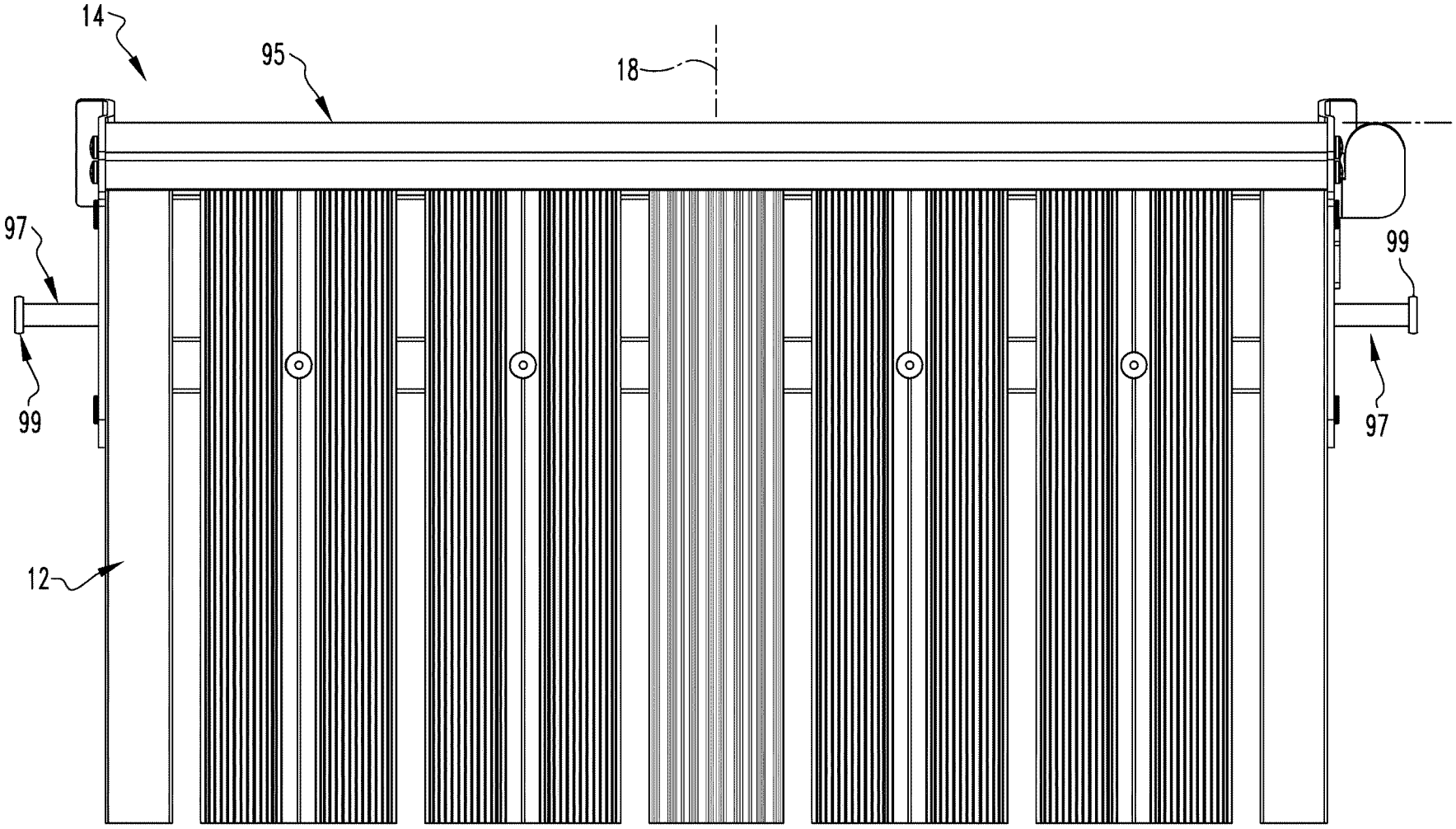
FIG. 6 is an overhead of the first end of the platform.

FIG. 6 shows an overhead view of the first end 14 of the platform 12 with the first leg assembly 20 hidden. There is an end cap 95 attached to the first end 14 of the platform 12. Each end of an axle 97 to which the first leg 22 and the second leg 24 are rotatably attached, respectively, extend from either side of the platform 12. Each end of the axle has a tip 99 which contacts the respective leg and holds the respective leg in place to the platform 12 while allowing the respective leg to rotate between the extended position and the folded position.

FIG. 7 shows the first end 14 of the platform 12 in phantom with the and the outline of the end cap 95 two Phillips screws secure the frame primary portion 50 to the end cap 95, which has Phillips screw holes in the corresponding positions on the end cap 95. For rivets, two on each side of the first leg assembly pivot axis 28 and tip 99 hold the frame primary portion 50 to the platform 12.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. An apparatus comprising:

a platform having a longitudinal axis;

a first leg assembly rotatably attached to the platform, the first leg assembly having:

a first leg, and a second leg in spaced relationship and in parallel with the first leg, wherein the first leg assembly rotates between an extended position and a folded position about a first leg assembly pivot axis;

a latch assembly coupled to the platform;

a stud attached to and extending partially away from the first leg without contacting the second leg, wherein the stud engages with the latch assembly when the first leg assembly is moved into the extended position and the latch assembly is in a secured position;

an L-shaped bracket having a primary portion to which the first leg is rotatably attached and to which the platform is attached, the L-shaped bracket at least partly disposed between the first leg and the platform and including a secondary portion extending away from the primary portion at an angle, wherein the secondary portion is shorter than the primary portion and provides a rotational stop for the first leg when the first leg is in the extended position, wherein the latch assembly is coupled to the secondary portion of the L-shaped bracket, wherein, when the latch assembly is moved out of the secured position by a pressing force against the latch assembly, the stud disengages from the latch assembly and the first leg assembly is free to rotate around the first leg assembly pivot axis.

2. The apparatus of claim 1 further comprising a latch pivot axis around which the latch assembly rotates and the first leg assembly pivot axis are in a spaced relationship and permanently fixed in place relative to each other.

3. The apparatus of claim 1 wherein the latch assembly includes a latch hook that engages with the stud.

4. The apparatus of claim 3 wherein the latch assembly includes a latch pivot about which the latch hook rotates from the secured position.

5. The apparatus of claim 1 wherein the latch assembly includes a latch actuator that moves the latch assembly out of the secured position when the pressing force is applied to the latch actuator.

6. The apparatus of claim 1 wherein the latch assembly includes a latch hook that engages with the stud and extends towards a middle of the platform.

7. The apparatus of claim 1 wherein the latch assembly includes a latch spring that biases the latch assembly in the secured position by applying a restoring force to automatically move the latch assembly back to the secured position after the latch assembly has been moved from the secured position.

8. The apparatus of claim 1 wherein the latch assembly includes a latch hook, wherein, when the first leg assembly is moved to the extended position from the folded position, the stud cams a leading edge of the latch hook, moves the latch hook, advances beyond the leading edge of the latch hook, and then locks in place under a restoring force of a latch spring after clearing the leading edge of the latch hook.

9. The apparatus of claim 1 wherein the L-shaped bracket includes an edge extending from the secondary portion to contact a cross bar attached to the first leg and the second leg when the first leg assembly is in the extended position to acts as the rotational stop.

10. The apparatus of claim 9 wherein a latch pivot extends outward from the secondary portion relative to the longitudinal axis of the platform, and a leg pivot extends to rotatably attached the first leg to the platform.

11. The apparatus of claim 1 wherein the stud has a circular cross section.

12. An apparatus comprising:

a platform having a first end and a longitudinal axis;

a bracket attached in proximity to the first end of the platform, the bracket including a primary portion coupled flush to a side edge of the platform and a secondary portion extending away from the primary portion at an angle to provide a free wall extending beyond the side edge and terminating in a bracket edge;

a first leg assembly having:

a first leg rotatably attached to the bracket, a second leg in spaced relationship and in parallel with the first leg, and a cross bar attached to the first leg and the second leg, wherein the first leg assembly rotates between an extended position and a folded position about a first leg assembly pivot axis, and wherein the bracket edge and the free wall provide a rotational stop to the first leg assembly at the extended position; and a latch assembly having a latch pivot axis, the latch assembly coupled to the free wall of the bracket, and wherein the latch pivot axis and the first leg assembly pivot axis are in spaced relationship and permanently fixed in place relative to each other, wherein, when the first leg assembly is moved into the extended position, the latch assembly locks the first leg assembly in the extended position when the latch assembly is in a secured position, wherein, when the latch assembly is moved out of the secured position, the first leg assembly is free to rotate partially around the first leg assembly pivot axis.

13. The apparatus of claim 12 wherein the latch assembly includes a latch spring that biases the latch assembly in the secured position by applying a restoring force to automatically move the latch assembly back to the secured position after the latch assembly has been moved from the secured position.

14. The apparatus of claim 12 wherein the latch assembly includes a latch actuator that moves the latch assembly out of the secured position when a pressing force is applied to the latch actuator.

15. The apparatus of claim 12 further comprising a stud attached to and extending partially away from the first leg without contacting the second leg, wherein the stud engages with the latch assembly when the first leg assembly is moved into the extended position and the latch assembly is in the secured position, wherein, when the latch assembly is moved out of the secured position by a pressing force against the latch assembly, the stud disengages from the latch assembly.

16. The apparatus of claim 12 further comprising a stud that engages with a latch hook of the latch assembly when the latch assembly is in the secured position.

17. The apparatus of claim 16 wherein when the first leg assembly is moved to the extended position from the folded position, the stud cams a leading edge of the latch hook, moves the latch hook, advances beyond the leading edge of the latch hook, and then locks in place under a restoring force of a latch spring after clearing the leading edge of the latch hook.

18. The apparatus of claim 16 wherein the stud has a circular cross section.

19. The apparatus of claim 12 wherein the bracket edge contacts the cross bar attached to the first leg and the second leg when the first leg assembly is in the extended position to act as the stop to the first leg assembly at the extended position.

* * * * *